United States Patent [19]

Dupre et al.

[11] Patent Number: 4,678,596

[45] Date of Patent: Jul. 7, 1987

[54] RINSE AID FORMULATION

[75] Inventors: Jean Dupre, Levittown; Andrea C. Keenan, Plymouth Meeting, both of Pa.

[73] Assignee: Rohm and Haas Company, Philadelphia, Pa.

[21] Appl. No.: 858,614

[22] Filed: May 1, 1986

[51] Int. Cl.[4] ..... C11D 3/37

[52] U.S. Cl. ..... 252/174.24; 252/174.21; 252/174.23; 252/DIG. 2

[58] Field of Search ..... 252/174.23, 174.28, 252/DIG. 14, 174.21, DIG. 2, DIG. 3

[56] References Cited

U.S. PATENT DOCUMENTS

| | | | |
|---|---|---|---|
| 3,627,686 | 12/1971 | Sabatelli et al. | 252/174.24 |
| 4,203,858 | 5/1980 | Chakrabarti | 252/174.24 |
| 4,443,270 | 4/1984 | Biard et al. | 252/174.21 |

*Primary Examiner*—Paul Lieberman
*Assistant Examiner*—Hoa Van Le
*Attorney, Agent, or Firm*—Marc S. Adler

[57] ABSTRACT

A rinse aid formulation containing a low foam non-ionic surfactant, a low molecular weight poly(meth)acrylic acid and high molecular weight stabilizing polymer is provided. The stabilizing polymer, when at least about 85 percent neutralized, compatibilizes the low foam surfactant with the low molecular weight poly(meth)acrylic acid in water producing a stable, homogeneous aqueous dispersion. The neutralized low molecular weight poly(meth)acrylic acid improves wetting of the substrate by the rinse water and reduces spotting. The stabilizer and poly(meth)acrylic acid do not increase the foam or interfere with the defoaming properties of the surfactant.

4 Claims, No Drawings

RINSE AID FORMULATION

FIELD OF THE INVENTION

This invention relates to a machine dishwasher rinse aid formulation useful for promoting wetting of the rinse water on substrates and thereby reducing spotting of the dried substrate surface. More particularly, the invention is directed to the use of an alkali neutralized high molecular weight polymer to compatibilize a low foam nonionic surfactant with a low molecular weight neutralized poly(meth)acrylic acid to form a stable, non-phase separating aqueous rinse aid dispersion.

BACKGROUND OF THE INVENTION

Rinse aids are invariably used in commercial and institutional machine dishwashers and frequently in household dishwashers. A final rinse of fresh water serves to displace pre-final rinse water and its attendant detergent and soil residues. In large commercial machines the final rinse water is normally introduced at a temperature of 180° F. or above; the high temperature being used to sanitize as well as to promote rapid flash drying of the tableware, glassware or plasticware (hereinafter collectively referred to as "substrate") surfaces as they exit the machine. In some "low energy" commercial dishwashers the final rinse water may be used at a lower temperature on the order of about 140° F., however, it may also contain about 50 parts per million (ppm) of a conventional chlorine releasing agent for sanitization. "Sanitization" in household dishwashers is achieved by effective batchwise cleaning with multiple wash and rinse cycles using fresh water.

Rinse aid formulations are aqueous solutions containing a low foam nonionic surfactant. The rinse aid is injected into the final fresh water rinse at a concentration of about 50 to about 100 ppm. The surfactant in the rinse water lowers the surface tension of the rinse water and improves the wetting action of the rinse water on the somewhat hydrophobic substrate surfaces. Improved wetting reduces the tendency of the rinse water to form drops containing dissolved solids on the substrate surface which give rise to spots upon drying. Accordingly, the functions of the surfactant in the rinse aid are to effectively reduce the surface tension during the draining period and to be low foaming so as to avoid traces of foam on the rinsed substrate which result in a residue upon evaporation.

In commercial dishwashers, the final rinse water will mix with and become the pre-final rinse water. The rinse water may also be fed back into the wash water or be used directly as the wash water for the next cycle. Consequently when a rinse aid is formulated the surfactant and any other additive should be chosen based on their effect in the wash bath as well as in the rinse water. An additional important aspect of a rinse aid, therefore, is the ability of the rinse aid to defoam food soils in the alkaline wash bath. Proteinaceous food soils are particularly prone to foam in agitated alkaline wash baths. Foam, or more specifically entrapped air in the wash spray, will reduce the mechanical efficiency of the spray and interfere with maximim soil removal. Many low foam surfactants are effective soil defoamers, however, other additives may interfere with soil defoaming.

While low foam surfactants have improved the wetting of rinse water on substrates, they have not completely eliminated spotting and streaking problems. It is known that the addition of a low molecular weight neutralized polyelectrolyte, such as polyacrylic acid, to the rinse water can further reduce spotting and filming or streaking. It is believed that these low molecular weight water soluble polymers can adsorb onto slightly soiled substrates and make the surface more hydrophilic. A more hydrophilic surface can be more readily wetted by the surfactant-containing rinse water. Poly(meth)acrylic polymers are especially useful because they do not contribute to foam formation and do not interefere with the soil defoaming activity of the low foam surfactants. A major obstacle, however, exists to the use of low molecular weight poly(meth)acrylic acids in rinse aids. This obstacle is due to the incompatibility of these polymers in aqueous rinse aid formulations containing low foam surfactants. Combining such polymers and surfactants in water results in phase separation. Upon standing for a short period of time the water containing these polymers and surfactants will form two or more layers of different compositions. This phase separation is obviously unsatisfactory since nonuniform addition of the desired components will occur as the formulation is injected into the machine. For example, the formulation may contain too little surfactant to provide adequate wetting or too much leading to excessive foam.

Hydrotropes such as sodium xylene sulfonate, cumene sulfonate and short chain alkyl sulfates have been used to raise the cloud point of low foam surfactants to permit the formulation of stable aqueous concentrates. For example see U.S. Pat. Nos. 3,563,901 and 4,443,270. These hydrotropes have little effect, however, on compatibilizing low foam surfactants with low molecular weight polymers in aqueous concentrates. Moreover, even in cases where hydrotropes give limited compatibility, they suffer from the major disadvantage of interfering with the food soil defoaming activity of the surfactants.

Water miscible solvents, such as isopropanol and propylene glycol, and hydrogen bond breaking compounds, such as urea, have also been proposed for use in formulating rinse aids containing low foam nonionic surfactants. However, they have been found to have little or no effect on compatibilizing polyacrylic acids with low foam surfactants. Combinations of a hydrotrope and such solvents offer some improvement over the use of either compound alone, but the combinations still result in rinse aids having limited compatibility and adversely effect food soil defoaming activity.

Low molecular weight polyelectrolytes have been combined with low foam surfactants in detergent formulations. U.S. Pat. No. 4,203,858 discloses a low foaming, phosphate-free, dishwashing composition comprising an alkali metal or ammonium carbonate, such as sodium carbonate, a water soluble salt of a polyelectrolyte having a molecular weight of from about 500 and 4,000 and optionally up to 10 weight percent of a foam-suppressing nonionic surfactant. The weight ratio of polyelectrolyte to carbonate ranges from 5:95 to 20:80. Typical of the polyelectrolytes are acrylic, methacrylic, maleic and itaconic acid polymers. Homopolymers and copolymers of acrylic and methacrylic acid having a molecular weight ranging from 504 to 1291 are preferred. The '858 patent discloses that the major differences between this composition and prior polyelectrolyte-built dishwashing compositions are the low concentration of polyelectrolyte and the poor metal ion sequestering capability of these polyelectrolytes. Other references disclosing poly(meth)acrylic acids and their salts in detergent and cleaning applications include U.S. Pat. Nos. 3,671,440; 3,853,981; 3,950,260; 3,933,673; 3,922,230 and 4,521,332. None of these references, however, address or offer solutions for combining polyelectrolytes with low foam surfactants in rinse aid concentrates.

It is an object of the present invention to compatibilize an aqueous rinse aid containing a low foam nonionic surfactant and a low molecular weight neutralized poly(meth)acrylic acid without the use of a hydrotrope.

It is a further object of the invention to provide a stable aqueous rinse aid dispersion which reduces spotting and filming while improving sheeting action and drainage.

SUMMARY OF THE INVENTION

We have discovered that a high molecular weight, substantially alkali neutralized methacrylic acid copolymer is useful as a compatibilizer or stabilizer for low foam nonionic surfactants and low molecular weight neutralized poly(meth)acrylic acids in water, and that a stable aqueous dispersion comprising from about 0.5 to about 20 weight percent low molecular weight poly(meth)acrylic acid, from about 5 to about 60 weight percent low foam nonionic surfactant and from about 0.3 to about 5.0 weight percent of said high molecular weight substantially neutralized methacrylic acid compatibilizer copolymer is useful as a rinse aid formulation.

The rinse aid formulation of the invention is a stable homogeneous dispersion which does not phase separate into layers upon storage or use and which provides improved wetting and spot reduction without adversely increasing foaming. In preparing the rinse aid dispersion it is necessary to adjust the pH of the dispersion to the range of about pH 7.5 to about pH 10.3 by the addition of alkali to neutralize at least about 85 percent of the acid groups in the compatibilizing polymer (hereinafter referred to as "substantially" neutralized).

DETAILED DESCRIPTION OF THE INVENTION

The rinse aid formulation of the invention contains a conventional low foam nonionic surfactant, a conventional low molecular weight neutralized poly(meth)acrylic acid polymer, and a high molecular weight substantially neutralized compatibilizing methacrylic acid copolymer.

The nonionic surfactants useful in the rinse aid may be any known low foam nonionic surfactant used in machine dishwashing applications. Typical suitable nonionic surfactants include the following commercially available materials: Triton ® CF-10 (an alkylaryl polyether) and Triton DF-16 (a modified polyalkoxylated alcohol) manufactured by Rohm and Haas Company; Pluronic ® L-62 (a polyoxyethylene-polyoxypropylene block copolymer) manufactured by BASF Wyandotte Corporation and Antarox ® BL-330 (a modified linear aliphatic alcohol polyethoxylated and chloro-terminated compound) manufactured by GAF Corporation. The rinse aid formulation of the invention may contain one or a mixture of such low foaming nonionic surfactants.

The rinse aid also contains a low molecular weight neutralized poly(meth)acrylic acid polymer. This polymer may be a homopolymer of acrylic or methacrylic acid or a copolymer formed from at least about 50 weight percent acrylic acid and 50 weight percent or less of a suitable copolymerizable comonomer. Suitable comonomers include lower alkyl ($C_2$–$C_4$) acrylates; methacrylic acid and lower alkyl($C_2$–$C_4$) methacrylates and amides, such as acrylamido sulfonic acids including 2-acrylamido-2 methylpropane sulfonic acid (AMPS). The poly(meth)acrylic acid is a low molecular weight polymer, or its alkali metal or ammonium salt, having a weight average molecular weight ranging from about 2,000 to about 40,000.

The high molecular weight compatibilizer polymer is a methacrylic acid copolymer formed of 25 to about 70 weight percent methacrylic acid and from about 75 to about 30 weight percent of one or more copolymerizable lower alkyl ($C_1$ to $C_6$) acrylate or methacrylates. Preferably the stabilizer polymer is formed from at least about 50 weight percent methacrylic acid. The weight average molecular weight of the compatibilizer polymer is at least 500,000 and may be as high as about eight million. The stabilizer polymer may also include a minor amount, up to about one weight percent, of a crosslinking monomer such as diallylphthalate, dimethacrylate of butane diol, allyl methacrylate, and ethylene glycol dimethacrylate. The copolymer must be alkali soluble or swellable and capable of being substantially neutralized by the addition of base at pH ranging from about pH 7.5 to about pH 10.3.

The aqueous rinse aid dispersion contains from about 0.5 to about 20 weight percent of the low molecular neutralized weight poly(meth)acrylic acid, from about 5 to about 60 weight percent of low foam nonionic surfactant and from about 0.3 to about 5.0 weight percent of the high molecular weight compatibilizing copolymer, the remainder of the dispersion being water.

When the high molecular weight compatibilizing copolymer is substantially neutralized by the addition of an alkaline material which reacts with at least 50 and up to 100 weight percent of available acid sites on the polymer backbone, the dispersion which results is homogeneous and remains stable at pH of from about pH 7.5 to about pH 10.3. The use of the high molecular compatibilizer solves the incompatibility or phase separation problem associated with aqueous systems containing a low foam surfactant and low molecular weight neutralized poly(meth)acrylic acid additive. The stable dispersion does not phase separate upon storage for a reasonable time or under actual use conditions and permits each component to effectively reduce spotting and filming and improve sheeting action without the need for a hydrotrope and without interfering with the foaming and defoaming action of the surfactant.

A preferred rinse aid formulation of the invention is an aqueous dispersion at a pH of pH 8 to pH 8.5 containing 15.0 weight percent nonionic surfactant, 2.0 weight percent low molecular weight poly(meth)acrylic acid, and 1.0 weight percent of the compatibilizing copolymer. It is preferably prepared by stirring the desired amount of the surfactant into an aqueous solution of the low molecular weight poly(meth)acrylic acid followed by the gradual addition of the compatibilizing polymer and substantial neutralization to the desired pH range.

The formulation may also contain other additives including sequestants such as NTA, EDTA, or sodium citrate and water miscible solvents such as isopropanol and propylene glycol.

We have found the rinse aid dispersions remain stable up to at least two (2) weeks at 50° C., are room temperature stable for at least 90 days, and pass five (5) freeze/thaw cycles.

The following examples are intended to illustrate the invention.

EXAMPLE 1

Preparation of Rinse Aid Formulations

The following procedure was used to prepare a rinse aid formulation of the invention containing 15.0 weight percent low foam nonionic surfactant, 2.0 weight percent low molecular weight poly(meth)acrylic acid, and 1.0 weight percent high molecular weight methacrylic acid copolymer compatibilizer.

In a first beaker 15.0 grams of first low foam nonionic surfactant Triton® CF10 (100% active) was admixed with 15.8 grams of a second low foam nonionic surfactant Triton® CF32 (95.0% active) and 8.2 grams of Acrysol® LMW45 (48% active), a polyacrylic acid polymer having a weight average molecular weight of about 4500, for about 5 minutes at 600 rpm. In a second beaker 10.0 grams of a (20% active) high molecular weight methacrylic acid copolymer compatibilizer (Compatibilizer A), formed by a standard aqueous free radical initiated emulsion polymerization of 34.97 wt percent ethyl acrylate, 65 weight percent methacrylic acid and 0.03 wt % dimethacrylate of butane diol as a crosslinking monomer was diluted with 147.0 grams of deionized water. This diluted polymer was then slowly added to the mixture being stirred in the first beaker to form a dispersion. Four grams of sodium hydroxide (50% active) was then gradually added to the first beaker to form 200.0 grams of the rinse aid formulation (Formulation A). The viscosity of the dispersion was about 450 cps as measured using a Brookfield viscometer at 12 rpm, spindle number 3. The dispersion had a pH of about pH 8.5 indicating that the high molecular weight compatibilizer was essentially neutralized (95.0–100%).

The stability of the formulation was then examined. The formulation remained stable—no phase separation—at the end of 2 weeks at 50° C. and after 5 freeze/-thaw cycles. The formulation remained stable at the end of 90 days after storage at room temperatures.

Similar rinse aid formulations employing different surfactants and surfactant mixtures, polyacrylic acids and compatibilizer copolymers were prepared using the above procedure.

Table 1 presents the composition of other compatibilizer copolymers used in preparing rinse aid formulations. All the compatibilizer polymers were prepared by standard free radial initiated aqueous emulsion polymerization reactions.

TABLE 1

| Compatibilizer | Composition (weight percents) | Mw |
|---|---|---|
| B | 35% ethylacrylate/65% methacrylic acid | 2,000,000 |
| C | 33% methacrylic acid/67% acrylate ester | 500,000 |
| D | 60% acrylate ester/39.7% methacrylic acid/0.3 crosslinking monomer | — |

EXAMPLE 2

Foaming and Defoaming

The following example illustrates that the addition of the low molecular weight polyacrylic acid and the high molecular weight compatibilizer copolymer do not interfere with the performance of the surfactant in the rinse aid formulation. Table 2 also presents comparative examples which illustrate the adverse effect of the addition of a hydrotrope (sodium xylene sulfonate (SXS)) when used in combination with a low foam surfactant and polyacrylic acid.

TABLE 2

| Formulation | Surfactant (wt %)[3] | Polyacrylic Acid, (wt %)[3] | Hydrotrope SXS, (wt %)[3] | Compatibilizer (wt %)[3] | Water Deionized (wt %) | Foam[1] cm | Defoam[2] cm |
|---|---|---|---|---|---|---|---|
| 1 | [4]CF-10 (7.5)/CF-32 (7.5) | — | — | — | 85 | 2.7 | 0.9 |
| 2 | CF-10 (7.5)/CF-32 (7.5) | [5]LMW45 (2.0) | — | A (1.0) | 82 | 2.7 | 1.1 |
| 3 | CF-10 (7.5)/CF-32 (7.5) | LMW45 (2.0) | — | B (1.0) | 82 | 2.6 | 0.6 |
| 4 | CF-87 (7.5)/DF-12 (7.5) | — | — | — | 85 | 2.1 | 1.2 |
| 5 | CF-87 (7.5)/DF-12 (7.5) | — | 10.0 | — | 75 | 2.6 | 2.7 |
| 6 | CF-87 (7.5)/DF-12 (7.5) | LMW45 (2.0) | 10.0 | — | 73 | 2.6 | 2.6 |

[1]FOAM TEST - A 0.01% test solution of the formulation at 50° C., agitated for 3 minutes at 16,000 rpm using a Hamilton Beach mixer. At the end of 3 minutes agitation was stopped and 15 seconds later, the foam height was measured.

[2]DEFOAM TEST - A 0.01% test solution of the formulation was used at 50° C. To this solution was added 0.75 wt % dry milk solids and 0.3 wt % alkaline base (35% sodium tripolyphosphate, 42% sodium metasilicate and 23% sodium carbonate). This mixture was then agitated for 3 minutes at 16,000 rpm using a Hamilton Beach mixer. At the end of 3 minutes agitation was stopped and 15 seconds later the foam height was measured.

[3]All weight percents are on an active basis.

[4]CF-10, CF-32, CF-87, DF-12 are Triton ® surfactants manufactured by Rohm and Haas Company.

[5]LMW 45 is ACRYSOL ® LMW 45 polyacrylic acid manufactured by Rohm and Haas Company.

Formulations 1–3 illustrate that Formulations 2 and 3 are low foam and are effective defoamers. They do not adversely effect the low foam performance of the surfactant (Formulation 1). Formulations 4–6 illustrate the adverse effect of the addition of a hydrotrope on food soil defoaming regardless of the presence of the polyacrylic acid. Note that the defoaming height is more than doubled when the hydrotrope is employed. Defoaming of food soils is dependent on the conditions employed and on the choice of surfactant, but as a general rule, a defoam height less than 2.0 cm is excellent.

EXAMPLE 3

Dishwasher Performance

The following rinse aid formulations, prepared according to the procedure of example 1, were evaluated for their ability to reduce spotting on glassware in a Hobart AM 14 dishwasher. Two glasses were put through four wash/rinse cycles. A detergent and dry milk solids were introduced into the wash cycle and each rinse aid formulation was added to the rinse cycle. The detergent was employed at a concentration of 0.25 wt percent. The detergent contained 25 wt % chlorinated trisodium phosphate, 25% sodium tripolyphosphate, 25% sodium hydroxide and 25% sodium metasilicate. The dry milk solids were added at a concentration of 0.10 wt %. Each of the formulations identified below were added to the rinse cycle at a concentration of 0.005 wt %. The results of the test are shown in Table 3.

TABLE 3

| Formulation | Surfactant Triton CF10 wt %[1] | Polyacrylic Acid Acrysol LMW 45 wt %[1] | Compatibilizer (A) Example 1 wt %[1] | Spots per-glass | Spotting by Visual Inspection |
|---|---|---|---|---|---|
| Comparative 7 | 15.0 | 0.0 | 0.0 | 31–50 | moderate |
| Comparative 8 | 0.0 | 2.0 | 0.0 | >50 | heavy |
| Comparative 9 | 15.0 | 0.0 | 1.0 | 31–50 | moderate |
| Comparative 10 | 15.0 | 2.0 | 1.0 | 11–20 | light |

[1]All weight percents are on an active basis.

The results using Formulation 10 demonstrates the reduction in spotting resulting from the combined effect of the surfactant, low molecular weight polyacrylic acid and high molecular weight poly(meth)acrylic copolymer compatibilizer as compared with comparative formulations 7,8, and 9.

Example 4

Effect of pH on Dispersion Stability

Table 4 illustrates the effect of pH, and the resulting percent neutralization of the compatibilizing polymer, on the stability of a rinse aid formulation of the invention. The formulation used for this experiment was identical to formulation 10 of example 3 containing 15.0 wt % low foam nonionic surfactant Triton CF-10, 2.0 wt % active of Acrysol LMW 45 polyacrylic acid and 1.0 wt % active of Compatibilizer A. The only change in the formulation procedure described in example 1 was the variation in the amount of sodium hydroxide added to the aqueous dispersion.

TABLE 4

| Dispersion pH | % Neutralization of Compatibilizer | Viscosity of[1] Dispersion, cp | Stability of[2] Dispersion |
|---|---|---|---|
| 6.5 | 60 | 435 | Unstable |
| 7.0 | 75 | 430 | Unstable |
| 7.5 | 87 | 420 | Stable |
| 8.0 | 93 | 420 | Stable |
| 8.5 | 100 | 365 | Stable |
| 9.0 | 100 + 5% excess NaOH | 350 | Stable |
| 9.5 | 100 + 10% excess NaOH | 335 | Stable |
| 10.3 | 100 + 15% excess NaOH | 300 | Stable |
| 10.5 | 100 + 20% excess NaOH | 181 | Unstable |

[1]The viscosity of the dispersion was measured using a Brookfield viscometer, spindle number 3, at 12 rpm.
[2]The term stability used in the table means that the dispersion did not phase separate: upon storage for 2 weeks at 50° C.; upon 5 freeze/thaw cycles; or upon storage at room temperature for 90 days.

The results illustrate that the compatibilizer should be at least about 87% neutralized by alkali to yield a stable dispersion, but that an excess of about 20% alkali over that needed to completely neutralize the compatibilizer will result in an unstable dispersion.

Table 4 also illustrates that suprisingly there is no direct correlation between the viscosity and the stability of the dispersion at the lower pH values.

EXAMPLE 5

Compatibilizer Concentration

This experiment illustrates the compatibilizing effect of the high molecular weight poly(meth)acrylic acid compatibilizer on the stability of the rinse aid formulation as a function of the concentration of the compatibilizer. The same rinse aid formulation described in example 4 and example 1 (Formulation A) was used with the only variation being in the choice of compatibilizer and concentration of the compatibilizer from 0.25 wt % to 5.0 wt % active. The results are shown in Table 5.

TABLE 5

| Compatibilizer (Table 1) | Compatibilizer Concentration wt % active | Viscosity[1] Cp | Stability[2] |
|---|---|---|---|
| A | 0.25 | 94 | Unstable |
| A | 0.50 | 166 | Stable |
| A | 0.75 | 272 | Stable |
| A | 1.00 | 420 | Stable |
| A | 1.50 | 1760 | Stable |
| A | 2.00 | 2270 | Stable |
| C | 1.00 | 402 | Stable |
| C | 5.00 | 1500 | Stable |

[1]Viscosity was measured using a Brookfield viscometer, spindle number 3 at 12 rpm.
[2]Stable means that the formulation did not phase separate upon storage for 2 weeks at 50° C., upon completion of 5 freeze/thaw cycles; and upon storage at room temperature for 90 days.

The results indicate that when the compatibilizer is employed at 0.25 wt % the viscosity of the dispersion was very low and a stable rinse aid dispersion was not achieved.

EXAMPLE 6

Surfactant Variations

This experiment illustrates that a number of conventional low foam nonionic surfactants may be employed in the rinse aid formulation of the invention without adversely effecting the stability of the dispersion. The formulation used was the same as in examples 5, 4 and 1 (Formulation A) only the surfactants being varied. The results are shown in Table 6.

TABLE 6

| Surfactant | Composition | Stability[1] |
|---|---|---|
| Triton CF10[2] | octylphenylpolyethoxy benzyl ether | Stable |
| Triton DF16[2] | modified polyalkyoxylated alcohol | Stable |
| Triton CF32[2] | alkylamine alkoxylate | Stable |
| Triton CF87[2] | modified terminated alkylarylether | Stable |
| Triton DF12[2] | modified polyethoxylated alcohol | Stable |
| Pluronic L62[3] | polyoxyethylene-polyoxypropylene block polymer | Stable |
| Antarox BL-330[4] | chloro terminated polyethoxylated linear alcohol | Stable |

[1]Stable means that the dispersion did not separate into phases; upon storage at 50° C. for 2 weeks, upon 5 freeze/thaw cycles; and upon storage at room temperature for 90 days.
[2]Manufactured by Rohm and Haas Company.
[3]Manufactured by BASF Wyandotte Corp.
[4]Manufactured by GAF Corp.

EXAMPLE 7

Poly(meth)acrylic Acid Variations

This experiment demonstrates the stability of the rinse aid formulation (Formulation A) when the composition of the poly(meth)acrylic acid component is varied. The variations to the poly(meth)acrylic acid component included varying the molecular weight of poly(meth)acrylic acid homopolymer, as well as the use of other copolymerizable comonomers in various amounts to form copolymers of various weight average molecular weight. These polymers and copolymers were prepared by a standard aqueous solution polymerization reaction utilizing conventional free radical initiators and chain transfer agents. The wetting data was obtained in the absence of surfactant and high molecular weight compatibilizer in order to identify the contribution of the polyacrylic acid polymers to wetting. The ability to wet a surface was determined by the reduction in the contact angle of a droplet of water on a soiled glass surface as compared with the reduction in the contact angle of a droplet of water containing the poly(meth)acrylic acid polymer.

The results indicate that the compatibilizer is effective to compatibilize a rinse aid formulation containing one or more conventional nonionic surfactants.

TABLE 7

| Poly(meth)acrylic Acrylic Acid wt % | Acid Polymer Comonomer Type wt % | Mw | Stability of[1] Formulation | Wetting[2] Effectiveness |
|---|---|---|---|---|
| 100 | — | 1000 | Stable | Not effective |
| 100 | — | 2000 | Stable | Moderately effective |
| 100 | — | 4500 | Stable | Excellent |
| 100 | — | 7500 | Stable | Excellent |
| 100 | — | 10000 | Stable | Excellent |
| 100 | — | 22000 | Stable | Moderately effective |
| 100 | — | 40000 | Stable | Moderately effective |
| 100 | — | 50000 | Stable | Not effective |
| 95 | EA[3] 5 | 13000 | Stable | Excellent |
| 95 | MAA[4] 5 | 10000 | Stable | Excellent |
| 91 | AMPS[5] 9 | 10000 | Stable | Moderately effective |
| 70 | MAA 30 | 3500 | Stable | Moderately effective |
| 50 | AOPA[6] 50 | 4910 | Stable | Moderately effective |
| | MAA 100 | 12000 | Stable | Moderately effective |

[1]All formulations were stable, they did not phase separate upon storage for 2 weeks at 50° C.; upon 5 freeze/thaw cycles or upon storage at room temperature for 90 days.
[2]Contact angle measurements were performed on glass slides soiled with protein soil such that the angle of a drop of water was 45 degrees. The soiled glass slide was soaked in 0.0005 wt % (5 ppm) of the polymer aqueous solution for 1 minute, rinsed and allowed to dry. A drop of polymer solution was then placed on the substrate and the contact angle was measured: "Not effective" means less than 5 degrees reduction in contact angle; "moderately effective" means a 5–10 degree reduction in contact angle; and "Excellent" means a greater than 10 degree reduction in contact angle.
[3]EA is ethylacrylate
[4]MAA is methacrylic acid
[5]AMPS is 2-acrylamido-2-methylpropane sulfonic acid
[6]AOPA is acryloxy propionic acid The results indicate that poly(meth)acrylic homopolymers having a Mw (weight average molecular weight) of 1000 or less or a Mw of 50,000 or higher do not provide effective wetting. It also demonstrates that copolymers formed from about 5 to 50 wt % copolymerizable comonomers contribute effectively to wetting.

EXAMPLE 8

High Molecular Compatibilizer Variations

This experiment demonstrates the effect of variations to the composition of the high molecular weight compatibililizer on the viscosity and stability of the rinse aid formulation. The FORMULATION of example 1 (Formulation A) was used with variations to the compatibilizer polymer component. Conventional thickeners were also examined for comparative purposes. All the high molecular weight compatibilizers were prepared by aqueous emulsion polymerization utilizing conventional emulsifiers and free radical initiators. The dispersions were alkali neutralized as in example 1. The results are shown in Table 8.

TABLE 8

| | Compatibilizer | Composition | Mw[1] | Viscosity[2] Cp | Stability[3] |
|---|---|---|---|---|---|
| 1 | A | | — | 922 | Stable |
| 2 | B | | 2,000,000 | 120 | Stable |
| 3 | C | | 500,000 | 402 | Stable |
| 4 | D | | — | 530 | Stable |
| Comparative 5 | Natrosol 25OHHR | hydroxyethyl cellulose | 250,000 | 312 | Not Stable |
| Comparative 6 | CMC-7H | carboxymethyl cellulose | 700,000 | 250 | Not Stable |
| Comparative 7 | CMC-7M | carboxymethyl cellulose | 250,000 | 98 | Not Stable |
| Comparative 8 | Xantham Gum | polysaccharide | — | 320 | Not Stable |

[1]Mw determined by gel permeation chromatography
[2]Viscosity measured using Brookfield viscometer spindle #3, 12 rpm
[3]Stability test same as in prior examples.

EXAMPLE 9

Concentration of Substantially Neutralized Low Molecular Weight Poly(Meth)Acrylic Acid Polymer and Low Foam Surfactant in Rinse Aid Table 9 illustrates that stable rinse aid formulations can be formulated to contain at least about 20 weight percent (active) substantially neutralized low molecular weight poly(meth)acrylic acid. As the concentration of the substantially neutralized low molecular weight poly(meth)acrylic acid polymer in the formulation is lowered to below about 0.3 weight percent active, the formulation remains stable, but the contribution to improved wetting by the rinse water formulation becomes negligible. Table 9 also illustrates that the rinse aid formulation can contain at least about 60 weight percent (active) of a low foam surfactant without adversely affecting the stability of the formulation. As with the substantially neutralized low molecular weight poly(meth)acrylic acid component, the lower concentration limitation on the surfactant in the rinse aid formulation is not the stability of the formulation. At surfactant concentrations below about 5 weight percent active, however, the formulation becomes too diluted to be practical with regard to the costs of packaging and shipping the formulation.

TABLE 9

| | FORMULATION (wt % active) | | | |
|---|---|---|---|---|
| Surfactant | Substantially Neutralized Low Molecular Weight Poly Acrylic Acid | Compatibilizer | Viscosity | Stability |
| Triton CF-10 (15) | Acrysol LMW45 (20) | A (1.5) | 1700 | Stable |
| Triton CF-10 (60) | Acrysol LMW45 (2.0) | A (1.5) | 450 | Stable |

What is claimed is:

1. A stable aqueous rinse aid dispersion comprising from about 0.5 to about 20 weight percent poly(meth)acrylic acid polymer having a weight average molecular weight ranging from greater than 1000 to less than about 50,000, from about 5 to about 60 weight percent nonionic surfactant, from about 0.3 to about 5.0 weight percent of a substantially alkali neutralized compatibilizer polymer formed from about 25 to about 70 weight percent methacrylic acid and from about 75 to about 30 weight percent of one or more copolymerizable lower alkyl acrylates or methacrylates and having a weight average molecular weight of at least about 500,000, and the balance being water.

2. The rinse aid dispersion of claim 1 having a pH ranging from about pH 7.5 to about pH 10.3.

3. The rinse aid dispersion of claim 1 comprising 2.0 weight percent low molecular weight poly(meth)acrylic acid, 15.0 weight percent nonionic surfactant, 1.0 weight percent of said high molecular weight compatibilizer polymer and 82 percent water, said dispersion having a pH ranging from about pH8 to about pH8.5.

4. A method of stabilizing an aqueous rinse aid formulation containing a mixture of about 5 to 60 weight percent of low foam nonionic surfactant and from about 0.5 to about 20 weight percent of a low molecular weight poly(meth)acrylic acid polymer having a weight average molecular weight ranging from greater than 1000 to less than about 50,000, comprising adding to said mixture from about 0.3 to about 5.0 weight percent of a high molecular weight polymer formed from about 25 to about 70 weight percent methacrylic acid and from about 75 to about 30 weight percent of one or more copolymerizable lower alkyl(meth)acrylates, said high molecular weight polymer having a molecular weight of at least about 500,000, and adding to said mixture a sufficient amount of alkali to substantially neutralize at least about 85 percent of the acid groups on the backbone of said high molecular weight polymer.

* * * * *